US005871382A

United States Patent [19]

Foulke

[11] Patent Number: 5,871,382

[45] Date of Patent: Feb. 16, 1999

[54] FLOATBOARD

[76] Inventor: Robert W. Foulke, 122 Avenida Dominguez, San Clemente, Calif. 92672

[21] Appl. No.: 877,791

[22] Filed: Jun. 18, 1997

[51] Int. Cl.[6] ..... B63B 35/73

[52] U.S. Cl. ..... 441/129; 472/129

[58] Field of Search ..... 441/129, 130, 441/136, 65, 35; 472/128, 129; 446/156; D21/237; D12/316; 440/13, 14, 19, 15, 22

[56] References Cited

U.S. PATENT DOCUMENTS

| | | | |
|---|---|---|---|
| D. 290,152 | 6/1987 | Wolfe | D21/237 |
| D. 304,751 | 11/1989 | Wolfe | D21/237 |
| 3,718,109 | 2/1973 | Shitsko | 440/14 |
| 4,662,851 | 5/1987 | Foster | 441/129 |

FOREIGN PATENT DOCUMENTS

| | | | |
|---|---|---|---|
| 2432433 | 4/1980 | France | 440/22 |

OTHER PUBLICATIONS

Orange County Register; Feb. 19, 1988; "Sporting California Fashion", Rad clothing expo is testimony to beachwear as big business; 4 pages.

Sentinel; "Pool, Spa & Water Sports Products"; 8 pages.

Earth & Ocean Sports, Inc.; "Wave Masters"; 4 pages.

*Primary Examiner*—Sherman Basinger

*Attorney, Agent, or Firm*—Stetina Brunda Garred & Brucker

[57] ABSTRACT

An improved floatboard having a manually operable articulating member formed thereon. The articulating member is designed to assume a first inwardly biased position and a second outwardly extended position. The articulating member is provided with a stop member designed and oriented to engage with a stop surface formed on the floatboard when the articulating member is actuated to assume the second outwardly extended position to thus prevent a catastrophic tear from forming between the articulating member and the floatboard. The articulating member is further preferably provided with a surface that will enable the member to be easily grasped and manipulated. The floatboard of the present invention may additionally be formed to assume the appearance of a particular animal or creature, with the articulating member simulating the jaw or claw of such animal or creature. The floatboard of the present invention may further be fabricated from three (3) layers of polyethylene foam in a sandwich-type arrangement to enhance the durability of the floatboard.

10 Claims, 2 Drawing Sheets

FLOATBOARD

FIELD OF THE INVENTION

The present invention relates generally to hand held floatboards, and more particularly, floatboards having articulating members with improved hinge and stop mechanisms formed thereon.

BACKGROUND OF THE INVENTION

Hand held floatboards are utilized extensively as a means for teaching children how to swim. In this regard, such floatboards provide a safe and fun way to keep a swimmer afloat while he or she practices a swimming motion.

To enhance the fun and enjoyment of using such floatboards, such floatboards may be formed to have the appearance of an animal or some other type of creature, and may further be provided with manually operable articulating members formed to look like the jaws or claws of an animal. By providing such articulating members, the user is thus provided a surface for gripping the floatboard, as well as for moving or operating the jaw or claw formed on the floatboard.

While providing floatboards with such articulating members has several practical advantages and adds fun to the use of the device, the prior art is deficient in providing a floatboard having an articulated member formed thereon that can withstand the rigors of aggressive play and handling. In this respect, such articulating members are typically formed on the floatboard such that the same may be pulled or otherwise deformed beyond their intended range of motion, thus causing the member to partially or completely tear off from the floatboard. As a result, the floatboard becomes permanently damaged and significantly less fun for the swimmer to use.

Accordingly, there is a need in the art for an improved floatboard having at least one manually operable articulating member formed thereon wherein the latter is substantially prevented from being pulled or deformed beyond its intended range of motion when in use. There is additionally a need in the art for such a floatboard where the articulating member is designed to be easily grasped and manipulated. There is still further a need in the art for a floatboard having an articulating member formed thereon that is of simple construction, easy to manufacture, and likewise may be fabricated in the form of a jaw, claw or similar type moving structure to provide fun for the user.

SUMMARY OF THE INVENTION

The present invention specifically addresses and alleviates the above-identified deficiencies in the prior art. Specifically, the present invention is directed to an improved floatboard wherein the improvement comprises a manually operable articulating member formed upon the floatboard. The articulating member is provided with a stop member formed thereon that is configured and oriented to engage with a stop surface formed on the floatboard when the articulating member is actuated. The stop member and stop surface are designed to engage one another such that the range of motion of the articulating member is fixed, which therefore prevents the articulating member from being hyperextended to a point where the same may be partially or completely torn from the floatboard. Preferably, the articulating member is provided with a handle or grip portion formed thereon so that the same may be easily grasped and manipulated. The floatboard may further preferably be formed to have the appearance of a particular animal or creature, such as lobster, shark, or dinosaur, with the articulating member being formed to look like and correspond with a jaw or claw of such animal or creature. To increase the structural durability of the floatboards of the present invention, such floatboards may be fabricated to have a sandwich-type construction comprised of three (3) layers of polyethylene foam, the outer layers of which having a first increased density and a middle layer having a lesser density.

It is therefore an object of the present invention to provide an improved floatboard having articulating members formed thereon with the latter being designed and configured to have a limited range of motion such that the articulating member cannot be torn from the floatboard when manipulated.

Another object of the present invention is to provide an improved floatboard that may be formed to have the appearance of a particular animal or creature which further includes an articulating member formed thereon that simulates the jaw or claw of such animal or creature.

Another object of the present invention is to provide an improved floatboard having an articulating member formed thereon wherein such articulating member may be easily grasped and manipulated.

A still further object of the present invention is to provide an improved floatboard having an articulating member formed thereon that may be readily and easily used, is of simple and durable construction, and is relatively inexpensive to manufacture.

BRIEF DESCRIPTION OF THE DRAWINGS

These, as well as other features of the present invention, will become more apparent upon reference to the drawings, wherein.

DETAILED DESCRIPTION OF THE PREFERRED EMBODIMENT

The detailed description set forth below in connection with the appended drawings is intended merely as a description of the presently preferred embodiments of the invention, and is not intended to represent the only forms in which the present invention may be constructed or utilized. The description sets forth the functions and sequence of steps for construction and implementation of the invention in connection with the illustrated embodiments. It is to be understood, however, that the same or equivalent functions and sequences may be accomplished by different embodiments that are also intended to be encompassed within the spirit and scope of the invention.

Figure 1:
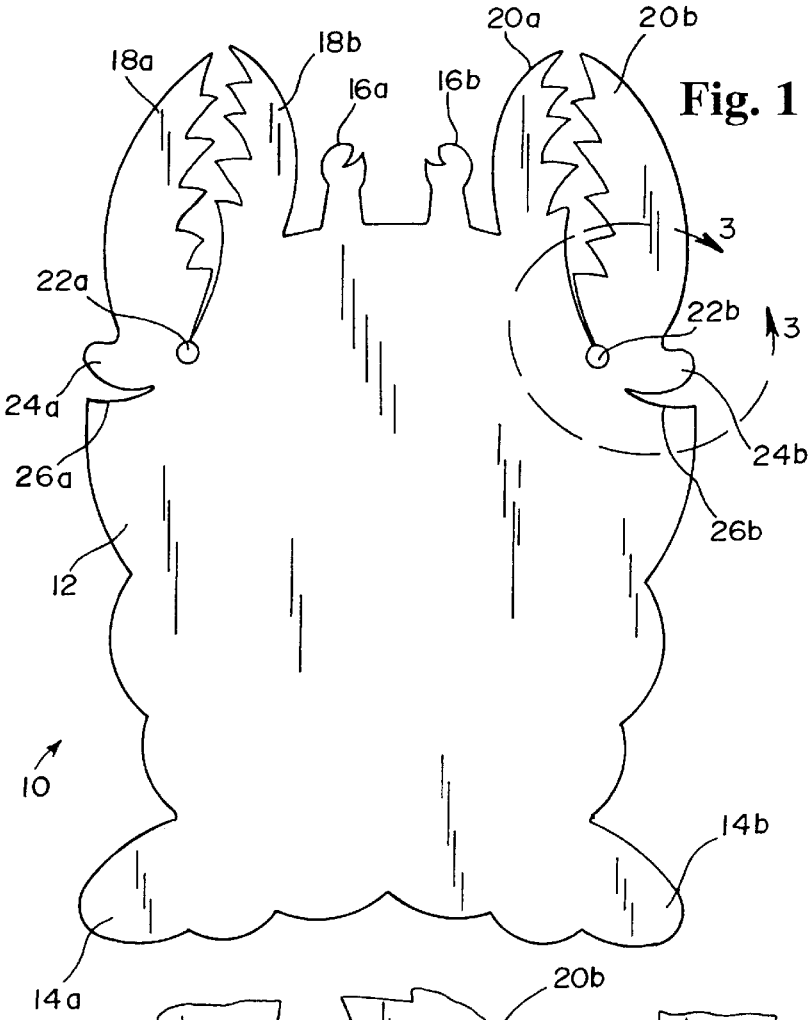
FIG. 1 is a frontal view of an improved floatboard having articulating, claw-like members formed thereon according to a preferred embodiment of the present invention, said floatboard being formed as a lobster.

Referring now to the drawings, and initially to FIG. 1, there is shown a floatboard 10 built in accordance with the preferred embodiment of the present invention. The floatboard 10 is generally defined by a floatboard plane. As illustrated, the floatboard 10 is preferably formed to assume the appearance of a lobster 12, and thus may be provided with tail portions 14*a*, 14*b*, eyes 16*a*, 16*b*, a first claw 18*a*, 18*b* and second claw 20*a*, 20*b*. While the embodiment shown resembles a lobster 12, it should be recognized at the outset that the floatboards of the present invention may be formed to assume any of a number of given animals or creatures that would be considered fun to play with, and may include but by no means limited to, sharks, tigers, alligators, and turtles. It should be further recognized that the floatboards of the present invention may be formed to assume other fun shapes such as boats, submarines, action heros, and the like.

The lobster floatboard 12 is further provided with first and second claws 18*a*, 18*b* and 20*a*, 20*b* wherein at least one of the respective claw members 18*a* and 20*b* comprise articulating members that may be manually manipulated to simulate claw-like movement. In this regard, each respective articulating claw member 18*a*, 20*b*, is attached to the lobster floatboard 12 via a hinge 22*a*, 22*b*, respectively, such that each such member may assume a first inwardly biased position, as shown, and a second outwardly extending position within the floatboard plane. Each articulating claw member 18*a*, 20*b* is further provided with a stop member formed thereon that is designed and oriented to engage a stop surface formed on the floatboard when either respective member is actuated to assume the outwardly extended position. Specifically, articulating claw 18*a* is provided with stop surface 24*a* designed to engage with stop surface 26*a* when the claw member 18*a* is actuated. Similarly, articulating claw member 20*b* is provided with stop member 22*b*, the latter of which will engage with stop surface 24*b* when the claw member 20*b* is actuated.

Figure 3:
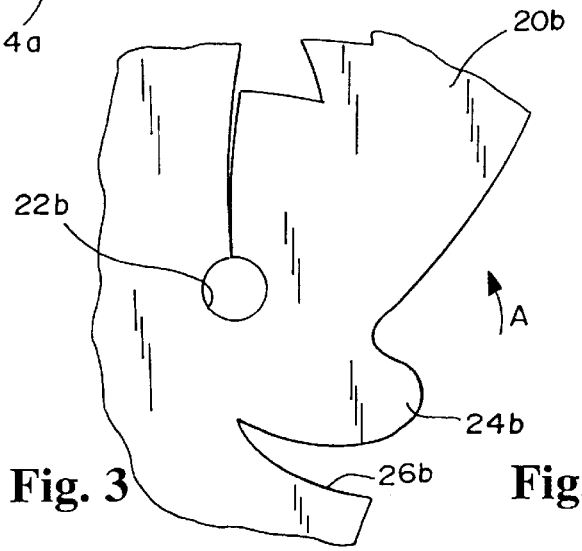
FIG. 3 is a view taken about circle 3—3 of FIG. 1.
Figure 4:
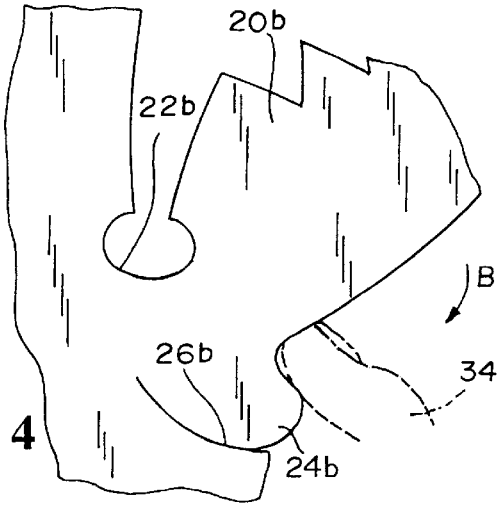
FIG. 4 is the view of FIG. 3 wherein a respective one of said articulating members formed on the floatboard being actuated to assume an outwardly extending position.

Referring now to FIGS. 3 and 4, there is more clearly shown the novel abutment arrangement between stop member 24*b* and stop surface 26*b* of claw member 20*b*. When at rest, as depicted in FIG. 3, articulating claw member 20*b* is inwardly biased about hinge 22*b*, as indicated by the direction A. In such configuration, stop member 24*b* is biased away from stop surface 26*b*. When the user wishes to simulate claw-like movement, the user need only depress stop member 24*b* in the direction indicated by the letter B.

Advantageously, by providing for the engagement of stop member 24*b* with stop surface 26*b*, the range of motion of articulating claw member 20*b* is fixed, and will be specifically designed such that the range of motion of the articulating member 20*b* is prevented from extending beyond the point that would cause a catastrophic tear to form between the articulating claw member 20*b* and the floatboard. As a result, the articulating claw member 20*b* (as well as articulating claw member 18*a*) may be repeatedly actuated about its full range of motion without risking the possibility that such articulating claw member may be hyperextended to the point where such member becomes partially or completely torn away from the body of the floatboard.

Figure 2:
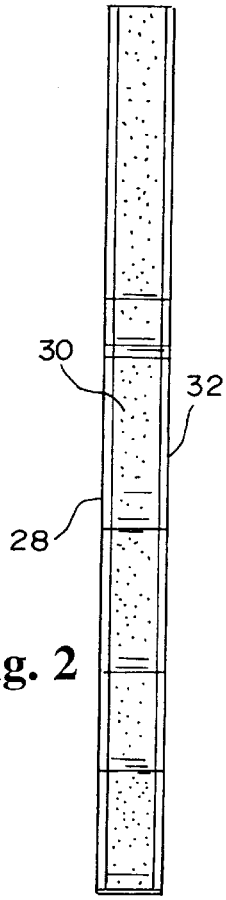
FIG. 2 is a side view of the floatboard of FIG. 1.

As will be recognized by those skilled in the art, the floatboards of the present invention may be fabricated from many well-known and commercially available materials. As illustrated in FIG. 2, the floatboard of the present invention may be formed from multiple layers of polyethylene foam or other like materials. In the preferred embodiment shown, the floatboard is comprised of a middle layer 30 sandwiched between first and third layers 28, 32. To provide for a more durable floatboard, such middle layer may preferably be fabricated from 1.2 pound density polyethylene closed cell foam and the first and third layers 28, 32 being fabricated from 6 pound density polyethylene closed cell foam. By constructing the floatboard from such materials in the aforementioned manner, there is thus provided a floatboard having significantly stronger construction than prior art floatboards, that also allows for the articulating claw members 18*a*, 20*b* thereof to be repeatedly actuated without risk that the same may tear or become deformed over time.

Figure 5:
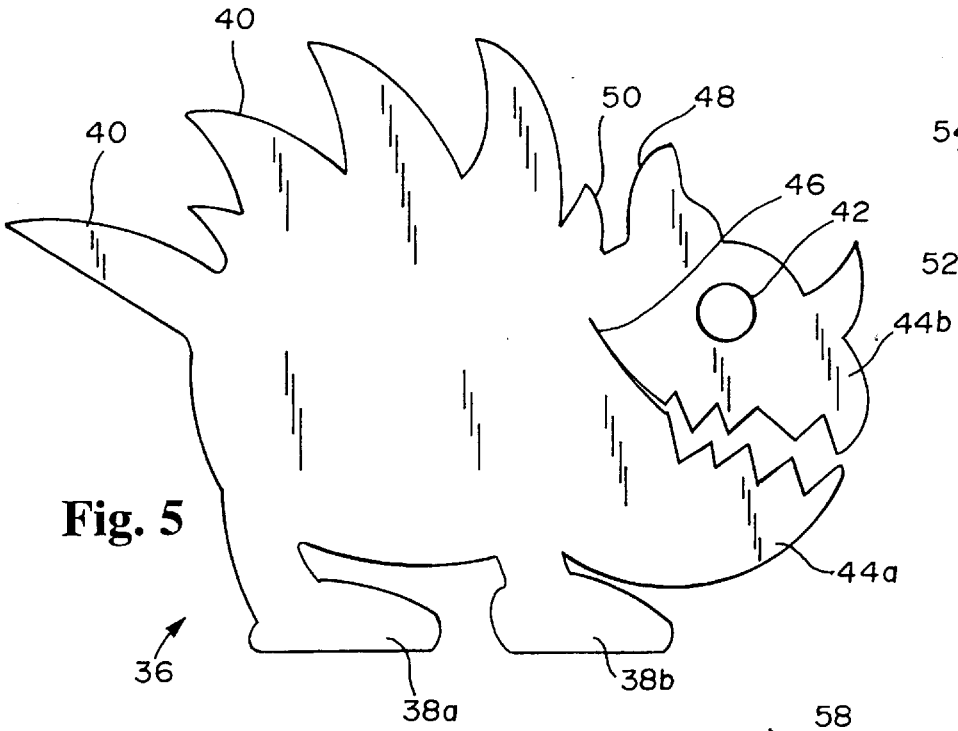
FIG. 5 is a frontal view of a floatboard having an articulating head portion formed thereon according to an alternative preferred embodiment of the present invention, said floatboard being formed as a dinosaur.

Referring now to FIGS. 5–8, and initially to FIG. 5, there is shown a floatboard 36 according to a second preferred embodiment of the present invention. The floatboard 36 is generally defined by a floatboard plane. As illustrated, floatboard 36 is formed to have the appearance of a dinosaur and is provided with feet members 38*a*, 38*b*, as well as spike members 40, to enable the floatboard to assume such appearance. The dinosaur floatboard 36 may be further provided with an aperture 42 to simulate the eye of the dinosaur.

Figure 6:
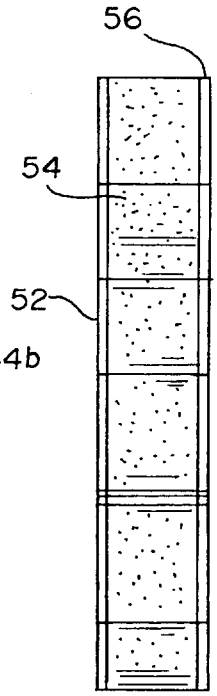
FIG. 6 is a side view of the floatboard of FIG. 5.

As with the first embodiment, the floatboard 36 may be fabricated from materials well-known to those skilled in the art, and may preferably be formed from the three (3) layers of polyethylene closed cell foam 52, 54, 56 arranged in the sandwich-type manner as depicted in FIG. 6.

The dinosaur floatboard 36 is further provided with an articulating member, namely head portion 44*b*, that, when used in combination with stationary lower jaw portion 44*a*, may be actuated to simulate a chewing or chomping motion within the floatboard plane.

Figure 7:
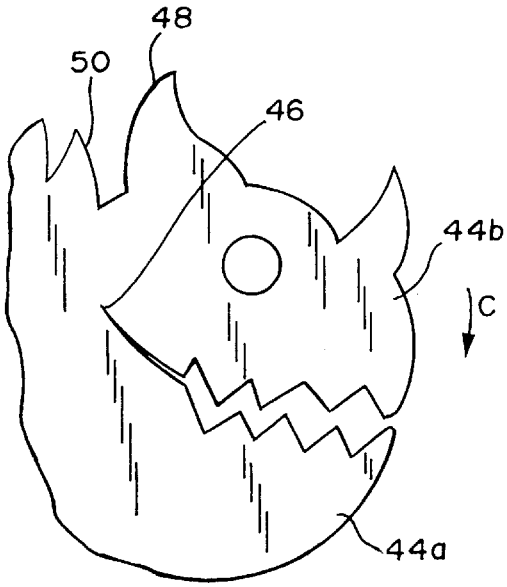
FIG. 7 is a partial side view of FIG. 5.
Figure 8:
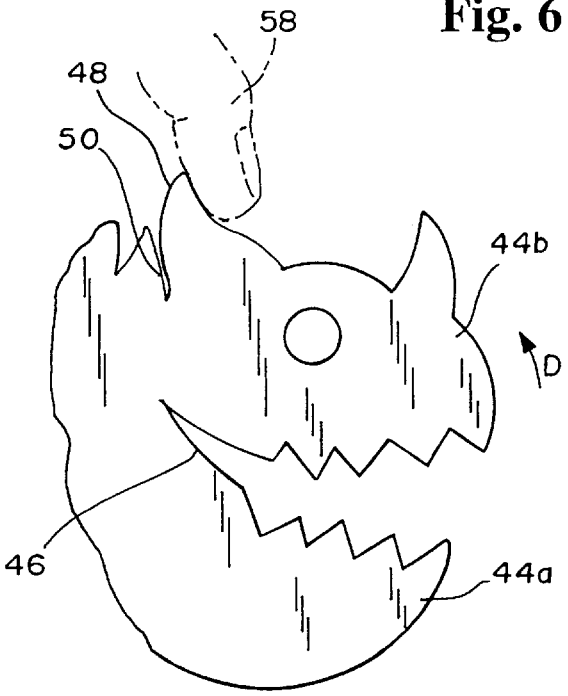
FIG. 8 is a side view of the head portion of FIG. 5 wherein said articulating head portion being actuated to assume an outwardly extending position.

As with the first embodiment, such articulating member 44*b* is provided with a stop member 48 configured and oriented to abut with stop surface 50 when the articulating member 44 is rotated about hinge 46, more clearly seen in FIGS. 7 and 8. As illustrated in FIG. 7, the articulating member or head portion 44*b* is downwardly biased in the direction indicated by the letter C towards lower jaw portion 44*a*. In such configuration, stop member 48 is biased away from stop surface 50.

Should the user wish to simulate a chomping or chewing motion, the user need only manually retract articulating head portion 44*b* by pulling back stop member 48 in the direction indicated by the letter D depicted in FIG. 8. The articulating head portion 44*b* will then retract about hinge 46 away from lower stationary jaw portion 44*a* to simulate a widening of the jaws of the dinosaur. Advantageously, by providing for the engagement of stop member 48 with stop surface 50, the range of motion of the articulating head portion 44*b* is controllably limited and with the articulating head portion 44*b* therefore being prevented from hyperextending to a point where a catastrophic tear may form between the articulating member 44*b* and the body of the floatboard.

Although the invention has been described herein with specific reference to a presently preferred embodiment thereof, it will be appreciated by those skilled in the art that various additions, modifications, deletions and alterations may be made to such preferred embodiment without departing from the spirit and scope of the invention. Accordingly, it is intended that all reasonably foreseeable additions, modifications, deletions and alterations be included within the scope of the invention as defined in the following claims.

What is claimed is:

1. An improved floatboard, wherein the floatboard being defined by a floatboard plane, said improvement comprising:

a) at least one manually operable articulating member formed on said floatboard within the floatboard plane, said articulating member being designed and configured to assume a first inwardly biased position and a second outwardly extended position within the floatboard plane, said articulating member having a stop member formed thereon for engaging with a stop surface formed on said floatboard when said articulating member is actuated to assume said second extended position, said stop member and said stop surface are designed and configured to engage one another such that further outward motion of said articulating member is prevented.

2. The improved floatboard of claim 1 wherein said stop member and said stop surface are designed and configured to engage one another such that when said articulating member is actuated to assume said second position, said articulating member is prevented from extending outwardly a distance sufficient to cause said articulating member to tear from said floatboard.

3. The improved floatboard of claim 2 wherein said stop member formed on said articulating member is provided with a surface formed thereon for manually actuating said articulating member.

4. An improved floatboard, said improvement comprising:

a) at least one manually operable articulating member formed on said floatboard, said articulating member being designed and configured to assume a first inwardly biased position and a second outwardly extended position, said articulating member having a stop member formed thereon for engaging with a stop surface formed on said floatboard when said articulating member is actuated to assume said second extended position, said stop member and said stop surface are designed and configured to engage one another such that said articulated member is prevented from extending outwardly a distance sufficient to cause said articulating when said articulating member is actuated to assume said second position member to tear from said floatboard, said stop member formed on said articulating member is provided with a surface formed thereon for manually actuating said articulating member.

5. The improved floatboard of claim 4 wherein said float board is provided with at least two said articulating members formed thereon.

6. The improved floatboard of claim 5 wherein said floatboard is formed to assume the appearance of a lobster, said articulating members being formed to assume the appearance of claw members of said lobster.

7. The improved float board of claim 4 wherein said floatboard is formed to assume the appearance of a dinosaur, said articulating member being formed to assume the appearance of the head portion of said dinosaur.

8. The improved floatboard of claim 4 wherein said floatboard is fabricated from polyethylene closed cell foam.

9. The improved floatboard of claim 8 wherein said floatboard is fabricated from a first, middle and third layer of polyethylene closed cell foam, said middle layer being disposed between said first and third layers.

10. The improved floatboard of claim 9 wherein said first and third layers are formed from 6 pound density polyethylene closed cell foam and said middle layer is formed from 1.2 pound density polyethylene closed cell foam.

* * * * *